United States Patent [19]

Pal et al.

[11] Patent Number: 4,938,186

[45] Date of Patent: Jul. 3, 1990

[54] INTERNAL COMBUSTION ENGINE VARIABLE STROKE MECHANISM

[76] Inventors: Leonhard J. G. Pal; Lyn L. Pal, both of 9 Jasmine Place, Umina, New South Wales 2257, Australia

[21] Appl. No.: 317,421

[22] Filed: Mar. 1, 1989

[30] Foreign Application Priority Data

Sep. 1, 1986 [AU] Australia ..... PH7767

[51] Int. Cl.[5] ..... F02B 75/32

[52] U.S. Cl. ..... 123/197 R

[58] Field of Search ..... 123/197 AC, 197 R, 78 BA, 123/78 E, 48 B

[56] References Cited

U.S. PATENT DOCUMENTS

| | | | |
|---|---|---|---|
| 2,398,640 | 4/1946 | Hickey | 123/48 B |
| 4,345,550 | 8/1982 | Finley | 123/78 E |
| 4,821,695 | 4/1989 | Freudenstein | 123/197 AC |

FOREIGN PATENT DOCUMENTS

| | | | |
|---|---|---|---|
| 108400 | 9/1939 | Australia . | |
| 602783 | 8/1934 | Fed. Rep. of Germany . | |
| 3145557 | 5/1983 | Fed. Rep. of Germany | 123/78 E |
| 528648 | 11/1921 | France . | |
| 607215 | 6/1926 | France . | |
| 662187 | 8/1929 | France . | |
| 1019771 | 1/1953 | France | 123/197 AC |
| 1059630 | 3/1954 | France | 123/197 AC |
| 86/00114 | 1/1986 | PCT Int'l Appl. . | |
| 353986 | 8/1931 | United Kingdom . | |
| 408114 | 4/1934 | United Kingdom . | |

*Primary Examiner*—David A. Okonsky

*Attorney, Agent, or Firm*—Fitch, Even, Tabin & Flannery

[57] ABSTRACT

In an internal combustion engine a piston reciprocates within a cylinder such that outward power strokes alternate with outward induction strokes. A power transfer lever pivotally mounted intermediate its ends has one end being connected to a throw of a crankshaft through a crank rod. Reciprocation of the piston causes rotation of the crankshaft by transfer of forces through the transfer lever and crank rod. The pivotal mount of the power transfer lever is supported by eccentric means rotatably driven through gear train at half cranks haft speed whereby the effective pivot point of the power transfer lever oscillates laterally of the power transfer lever causing successive outward strokes of the piston to be alternately long and short strokes. The engine may therefore be arranged so that the power stroke is shorter than the induction stroke.

5 Claims, 4 Drawing Sheets

INTERNAL COMBUSTION ENGINE VARIABLE STROKE MECHANISM

This is a continuation of International Application No. PCT/AU87/00299, filed Sept. 1, 1987 wherein the United States is designated.

The present invention relates to internal combustion piston engines.

Traditionally internal combustion piston engines have had a piston intake stroke equal to the piston power stroke. To enhance the performance of these engines, attempts have been made to facilitate delivery of additional air into the combustion chamber by the use of air pumps such as turbines. This then enables the delivery of additional fuel to the combustion chamber.

The above attempts to increase the fuel intake have required the use of expensive and often failure prone equipment.

There is also known internal combustion engines which employ a pivoted lever to connect the crank shaft with the piston. The lever is pivoted intermediate its ends. These known internal combustion engines have also only provided an intake piston stroke equal to the power piston stroke.

It is the object of the present invention to overcome or substantially ameliorate the above disadvantages.

There is disclosed herein an internal combustion piston engine having an interacting piston and cylinder co-operating to provide a combustion chamber, a power transmission lever pivoted intermediate its ends and having one end pivotally attached to said piston so that linear reciprocation of said piston causes angular oscillation of said lever, a main shaft having an eccentric connection coupling the other end of said lever with said main shaft so that oscillation of said lever causes rotation of said shaft, a pivot means supporting said lever, said pivot means including an eccentric member having a first axis about which said member rotates, and an eccentric portion pivotally supporting said lever so that said lever pivots about an eccentric axis eccentric with respect to said first axis, and drive means to cause rotation of said eccentric means at half the angle of velocity of said main shaft so that every second stroke of said piston is a longer stroke.

There is further disclosed herein an internal combustion piston engine having an interacting piston and cylinder co-operating to provide a combustion chamber, a power transmission lever pivoted intermediate its ends and having one end pivotally attached to said piston so that linear reciprocation of said piston causes angular oscillation of said lever, a main shaft having an eccentric connection coupling the other end of said lever with said main shaft so that oscillation of said lever causes rotation of said shaft, a pivot means supporting said lever, and wherein said pivot means is movable longitudinally of said lever to vary the capacity of said chamber.

A preferred form of the present invention will now be described by way of example with reference to the accompanying drawings, wherein.

Figure 1:
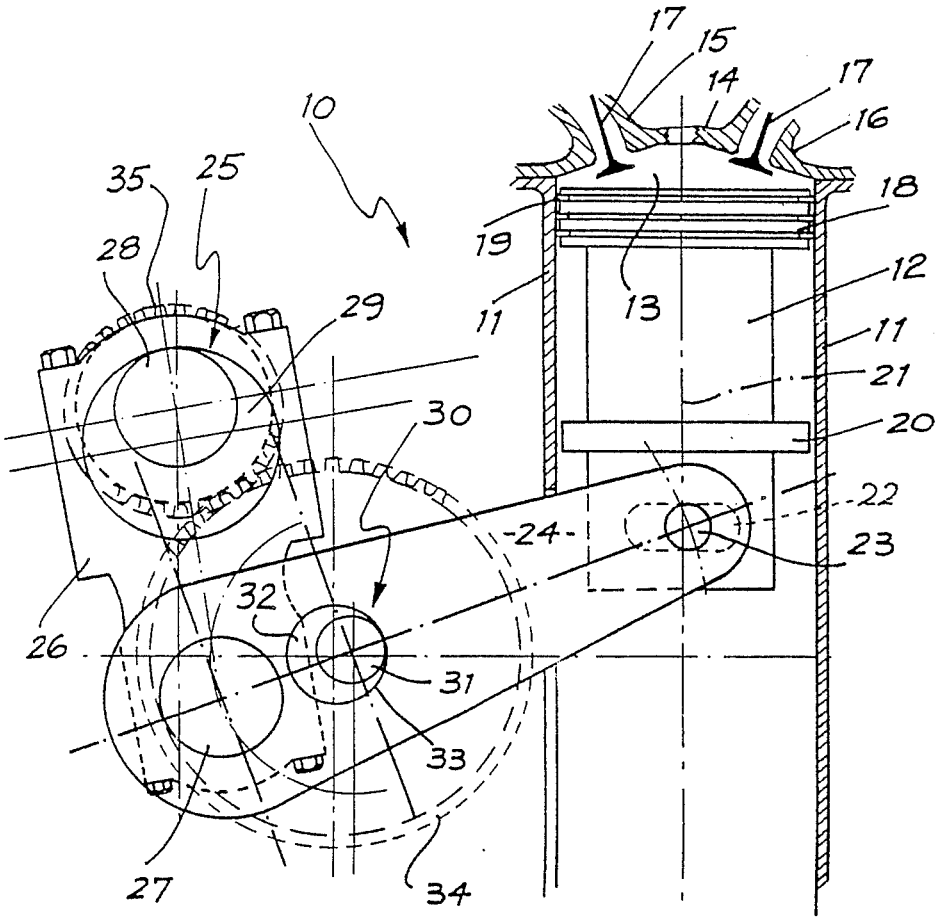
FIG. 1 is a schematic pass sectioned end elevation of a portion of an internal combustion piston engine.
Figure 2:
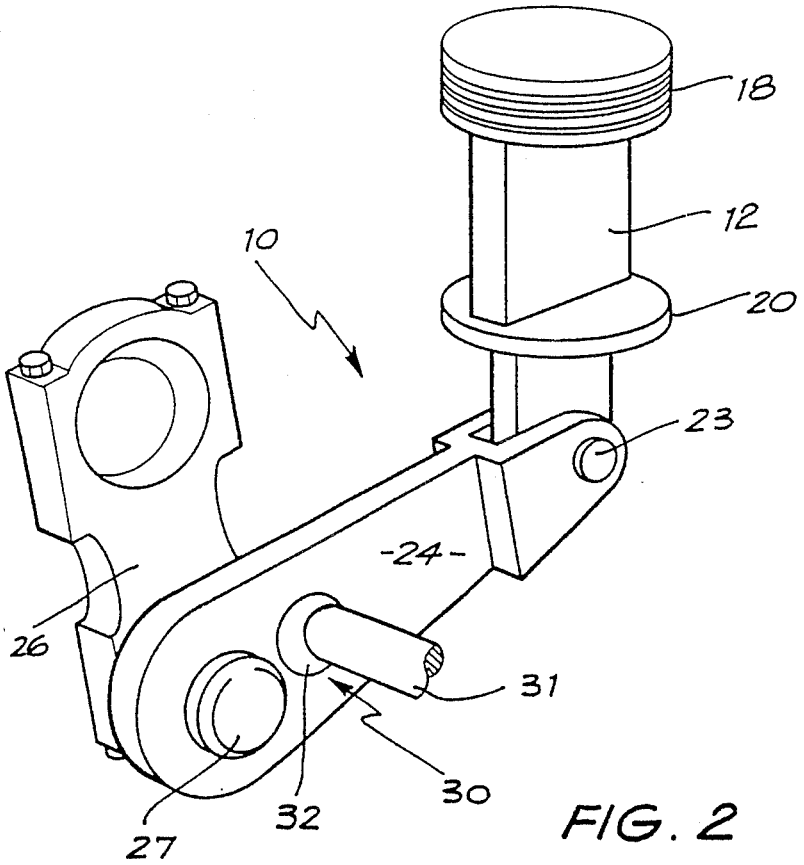
FIG. 2 is a schematic top perspective view of the internal combustion piston engine portion of FIG. 1.

In FIGS. 1 and 2 there is schematically depicted a portion 10 of an internal combustion piston engine. The portion 10 includes a cylinder 11 which slidably receives a piston 12 so as to provide a combustion chamber 13 in co-operation with a cylinder head 14. Provided in the head 14 is an intake passage 15 and outlet passage 16. The passages 15 and 16 are provided with valves 17 which are co-ordinated by means of a conventional gear or chain mechanism.

The piston 12 has a piston head 18 with appropriate rings 19. The lower end of the piston 19 is further provided with a flange 20 which inhibits transverse vibration and/or movement of the piston 19 relative to the longitudinal axis 21 of the cylinder 11.

The lower end of the piston 12 is provided with a slot 22 through which a pin 23 passes. The pin 23 is slidably retained in a slot 22 and is movable in a direction transverse of the axis 21.

A power transfer lever 24 is pivotally mounted by means of an eccentric assembly 30. The lever 24 is attached to the pin 23 so that power may be transferred between the piston 12 and the main crank shaft 25. One end of the lever 24 is pivotally attached to a crank rod 26 extending to the main crank shaft 25. A pin 27 pivotally connects the lever 24 with the rod 26.

The shaft 25 has a main shaft portion 28, and an eccentric portion 29 to which the rod 26 is attached.

The eccentric assembly 30 consists of a rotatably driven shaft 31 having an eccentric portion 32 which is slidably received within a circular aperture 33 formed in the lever 24. The shaft 31 is provided with a gear 34 meshingly engaged with a gear 35 fixed to the main shaft portion 28. The gears 34 and 35 have a gear ratio of 2:1, accordingly the shaft 31 is driven at half the angular velocity of the shaft 28.

Due to the eccentric portion 32, and the ratio of the gears 34 and 35, every second stroke of the piston 12 will be a longer stroke, relative to the previous stroke. This longer stroke normally would be an intake, stroke, and the shorter stroke a power stroke. The relative lengths of the power stroke and the intake stroke can be governed by the magnitude of the eccentric 32 and the positioning of its eccentric assembly 30.

Figure 3:
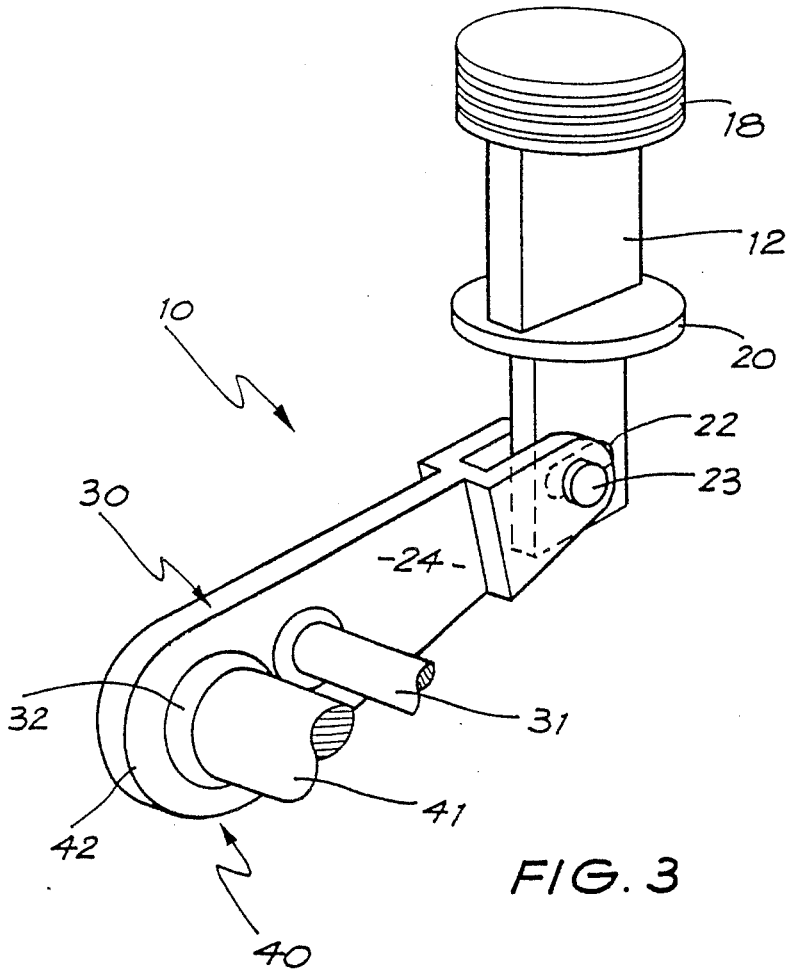
FIG. 3 is a schematic top perspective view of an alternative portion of an internal combustion piston engine.

In FIG. 3 an alternative arrangement to that shown in FIGS. 1 and 2 is shown. In FIG. 3 power is transmitted directly to a main shaft 40 having a shaft portion 41 and an eccentric portion 42 engaging the lever 24.

Figure 4:
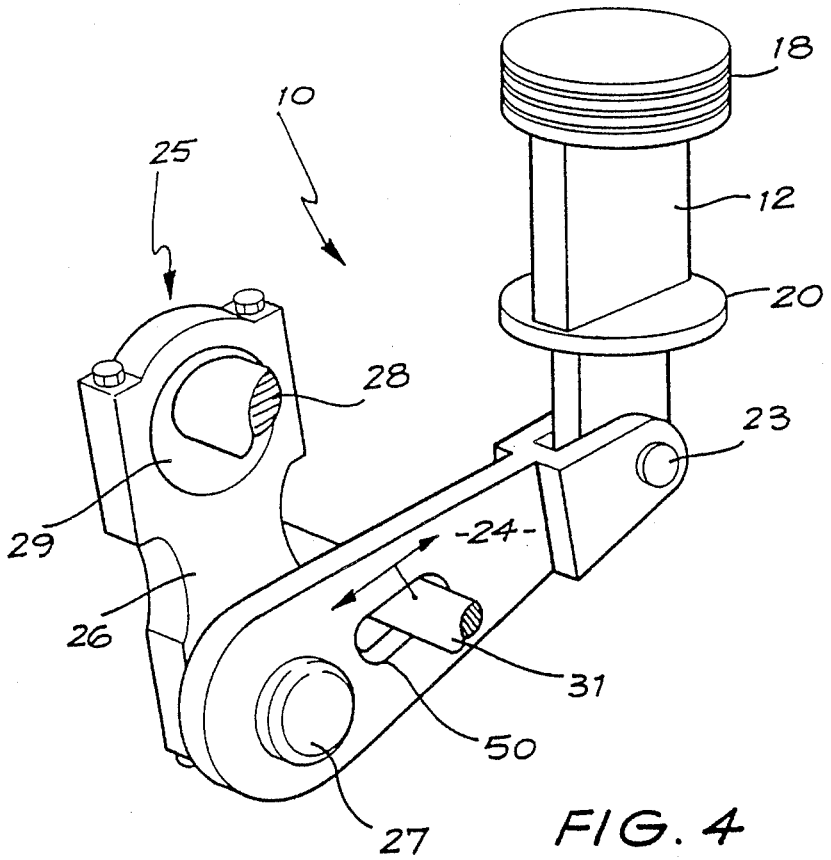
FIG. 4 is a schematic top perspective view of a further alternative construction of the engine and FIGS. 1 and 3.

FIG. 4 illustrates a further modification of the engine of FIGS. 1 and 3. In this embodiment the engine 10 has a slot 50 through which the shaft 31 passes. The shaft 31 is movable longitudinally of the slot 51 to vary the capacity of the chamber 13.

We claim:

1. An internal combustion piston engine having an interacting piston and cylinder co-operating to provide a combustion chamber, a power transmission lever pivoted intermediate its ends and having one end pivotally attached to said piston so that linear reciprocation of said piston causes angular oscillation of said lever, a main shaft having an eccentric connection coupling the other end of said lever with said main shaft so that oscillation of said lever causes rotation of said main shaft, a pivot means supporting said lever, said pivot means including an eccentric portion mounted for rotation about a first axis, said eccentric portion pivotally supporting said lever so that said lever pivots about an eccentric axis eccentric with respect to said first axis, and drive means to cause rotation of said eccentric portion at half the angle of velocity of said main shaft so that every second stroke of said piston is a longer stroke.

2. The internal combustion engine of claim wherein said eccentric connection includes a crank rod pivotally attached to the other end of said lever, and pivotally attached to said main shaft.

3. The internal combustion engine of claim 1 further including a pin and slot coupling said lever with said piston to accommodate relative movement between said piston and said lever.

4. The internal combustion engine of claim 3 wherein said pivot means includes a shaft upon which is mounted said eccentric portion pivotally supporting said lever, and said drive means includes a first gear driven by said main shaft, and a second gear meshingly engaged with said first gear and driving the shaft of said pivot means.

5. The internal combustion engine of claim 2 further including a pin and slot coupling said lever with said piston to accommodate relative movement between said piston and said lever.

* * * * *

UNITED STATES PATENT AND TRADEMARK OFFICE

CERTIFICATE OF CORRECTION

PATENT NO. : 4,938,186

DATED : July 3, 1990

INVENTOR(S) : Leonard J. G. Pal et al.

It is certified that error appears in the above-identified patent and that said Letters Patent is hereby corrected as shown below:

Column 3, line 8, after claim, insert --1--.

Signed and Sealed this

Twenty-seventh Day of August, 1991

*Attest:*

HARRY F. MANBECK, JR.

*Attesting Officer*

*Commissioner of Patents and Trademarks*